United States Patent [19]

Edwards

[11] 3,948,764

[45] Apr. 6, 1976

[54] CATALYST SCREENING UNIT

[75] Inventor: Tommy Ray Edwards, Dickinson, Tex.

[73] Assignee: Browning-Ferris Industries, Inc.

[22] Filed: Sept. 23, 1974

[21] Appl. No.: 508,449

[52] U.S. Cl. ..... 209/30; 209/250; 209/321

[51] Int. Cl.[2] ..... B07B 7/06

[58] Field of Search ..... 209/250, 21–25, 209/30–33, 133, 312, 318, 321, 404, 405; 23/288 R, 288 C

[56] References Cited

UNITED STATES PATENTS

| | | | |
|---|---|---|---|
| 2,359,431 | 10/1944 | Loucks | 209/404 |
| 2,567,207 | 9/1951 | Hoge | 209/31 X |
| 2,978,859 | 4/1961 | Tubbs | 56/328 R |
| 3,236,380 | 2/1966 | Brastad et al. | 209/321 |
| 3,250,389 | 5/1966 | Scruby et al. | 209/250 |
| 3,325,007 | 6/1967 | Erlenstadt et al. | 209/325 X |
| 3,363,769 | 1/1968 | Wilmot et al. | 209/405 X |
| 3,662,886 | 5/1972 | Kennedy | 209/250 |
| 3,804,245 | 4/1974 | Pendleton | 209/250 X |

*Primary Examiner*—Frank W. Lutter
*Assistant Examiner*—Ralph J. Hill
*Attorney, Agent, or Firm*—Pravel & Wilson

[57] ABSTRACT

A catalyst screening unit having a housing which receives incoming feed catalyst under positive pressure, a screen for sizing and separating whole catalyst from broken catalyst, dust, and fines, a vibrating member to vibrate the housing and the screen therewith, and a lower, waste chamber for collecting broken catalyst and fines to be directed outwardly therefrom the housing, and having vacuum provisions therewith for removing dust separately from the fines, such that the cleaned whole catalyst may be used within a catalytic reactor.

2 Claims, 2 Drawing Figures

CATALYST SCREENING UNIT

BACKGROUND OF THE INVENTION

The field of this invention is catalyst screening units, particularly of the type used for cleaning incoming feed catalyst prior to loading the same within a catalytic reactor.

In the loading of catalytic reactors, it is manifest that substantial care in cleaning catalyst be exercised for proper long-life reactor operation thereof. Since many catalysts contain costly noble metals, such catalysts are of considerable expense even when only a small portion thereof contains such noble metals. It, therefore, is extremely important that care be taken to prevent damage to fragile catalyst while cleaning the same prior to loading into a reactor. Thus, from both operational and economic viewpoints, it is of substantial importance that the catalyst not only be thoroughly cleaned of particles, such as broken catalyst, fines and dust, which interfere with proper reactor operation, but also care be taken to minimize attrition of costly catalysts when loading the same.

Prior art screening devices include those such as U.S. Pat. Nos. 3,685,651 and 3,250,389.

SUMMARY OF THE INVENTION

The present invention relates to a new and improved catalyst screening unit having a housing with a catalyst receiving chamber separated from a lower, waste chamber by an inclined screen. The housing includes an inlet for delivering incoming feed catalyst into the catalyst receiving chamber under positive pressure. A vibrating member is mounted with the housing for vibrating the same with the screen having properly sized openings therewith to allow sizing of the whole catalyst, broken catalyst, fines, and dust with the screen by vibration thereof. Furthermore, the lower waste chamber includes a vacuum source for removing the dust from within the housing separately from the broken catalyst and fines which are sized by the screen and directed outwardly from the waste chamber.

DESCRIPTION OF THE PREFERRED EMBODIMENT

Figure 1:
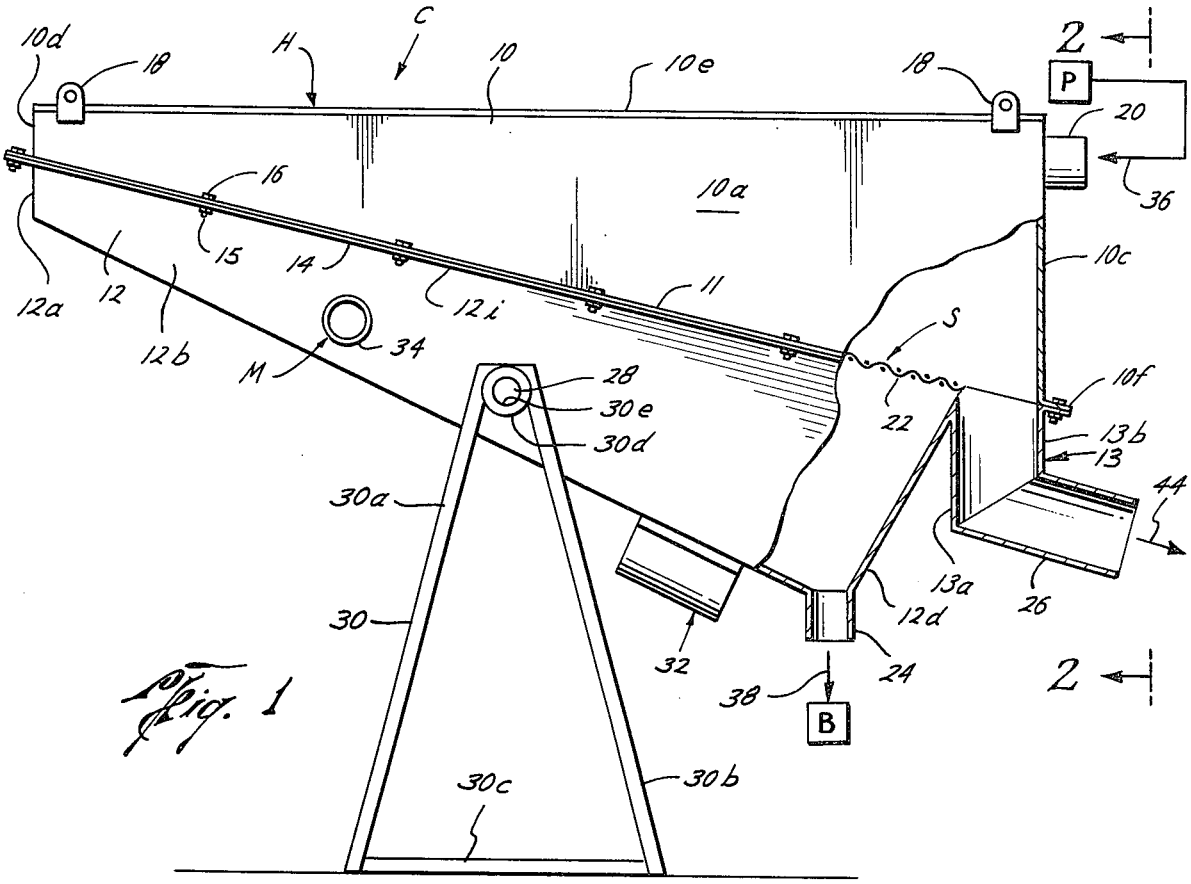
FIG. 1 is an elevational view, partly in section, of the catalyst screening unit of the present invention.

Referring to the drawings, the letter C designates the catalyst screening unit of the preferred embodiment of the present invention. The catalyst screening unit C includes a housing H having a screen S therewith. Vibrating means V and vacuum means M including first and second vacuum means A,B are suitably mounted with the housing H for agitating incoming feed catalyst upon the screen S, and for removing broken catalyst, fines, and dust from the housing H, respectively, for cleaning and sizing incoming feed catalyst.

The catalyst screening unit C includes a housing H having an upper, catalyst receiving chamber 10 and a lower, waste chamber 12 separated by an inclined screen S. The catalyst receiving chamber 10 has side walls 10*a*, 10*b*, front end wall 10*c*, rear end wall 10*d* and top portion 10*e*. A depending lip 11 skirts the lowermost perimeter of the catalyst receiving chamber 10 adjacent to sides 10*a*, 10*b*, 10*c*, and 10*d*.

The lower, waste chamber 12 includes a rear, preferably triangular-shaped portion 12*a*, inclined sides 12*b*, 12*c*, and a partition 12*d*. An outlet chamber 13 is preferably mounted adjacent to the lower, waste chamber 12 such that the outlet chamber 13 has a partition 13*a* mounted adjacent partition 12*d* of the waste chamber 12. The outlet chamber 13 also has a front portion 13*b* and inclined sides 13*c*, 13*d*. An outwardly depending lip 14 extends about the uppermost perimeter of the waste chamber 12 and the outlet chamber 13.

The outwardly depending lips 11, 14 are substantially identical to one another and are in fitting engagement. A plurality of holes 15 are formed in the lips 11, 14 to accommodate suitable fasteners 16 such as bolts, screws, and the like. Thus, the catalyst receiving chamber 10, the waste chamber 12, and the outlet chamber 13 are mounted together with the fasteners 16 having the screen S disposed therebetween the catalyst receiving chamber 10 and the waste chamber 12. Preferably, the front wall 10*c* is of greater height than the rear wall 10*d* of the catalyst receiving chamber such that the screen S therebetween chambers 10, 12 is at an angle of repose that is inclined with respect to the horizontal.

The catalyst receiving chamber 10 has lifting tabs 18 mounted with the catalyst receiving chamber 10 on the uppermost portion of the side walls 10*a*, 10*b* adjacent to the top portion 10*e* and front and rear walls 10*c*, 10*d*, respectively. The lifting tabs 18 permit ease in removal of the catalyst receiving chamber 10 when it is desired to inspect and/or repair the interior portion of the housing H.

Inlet 20 is mounted preferably in the uppermost central portion of the front wall 10*c* of the catalyst receiving chamber 10 adjacent to the top 10*e* for receiving and delivering incoming feed catalyst into the catalyst receiving chamber 10 under positive pressure.

It will be appreciated that feed catalyst is of generally a cylindrical or spherical configuration and includes whole catalyst, broken catalyst, fines, and dust as it enters the catalyst screening unit S of the present invention. Thus, the inlet 20 provides an appropriate opening for injecting the incoming feed catalyst into the catalyst screening unit C of the present invention.

The screen S preferably includes a wire grid 22 having suitable openings (not numbered) formed therein for proper sizing of the cataylst particles. That is, the grid sizing of the wire grid 22 is such that whole catalyst will not fall through the openings formed therein. However, broken catalyst, fines, and dust should be able to freely fall therethrough the wire grid 22 for proper screening thereof. The wire grid 22 of the screen S is mounted therebetween chambers 10, 12 extending from adjacent the lips 11, 14, adjacent the rear walls 10*d*, 12*a*, respectively, adjacent side walls 10*a*, 10*b*, 12*b*, 12*c* until the point of intersection of partitions 12*d* and 13*a* wherein the screen S terminates.

The waste chamber 12 is formed in a trough-like fashion such that the sides 12*b*, 12*c* are disposed in an inclined configuration. The inclined sides 12*b*, 12*c* together with rear wall 12*a* being shorter in height than partition 12*d* form an inclined trough for collecting broken catalyst and fines therein. A vacuum outlet 24 is affixed to the lowermost trough portion of the waste chamber 12 for directing the broken catalyst and fines outwardly therefrom, as will be more fully discussed hereinbelow. Partition 13*a* adjacent to partition 12*d* divides the waste chamber 12 from the outlet chamber 13. An outlet 26 is appropriately mounted with outlet chamber 13 at the lowermost trough portion thereof.

Mounting pins 28 are mounted with the inclined sides 12*b*, 12*c* of the waste chamber 12 and extend outwardly therefrom to support the housing H on support brackets 30. The support brackets 30 are preferably of a general triangular configuration having sides 30*a*, 30*b* and brace 30*c*. Adjacent to the uppermost portion where sides 30*a*, 30*b* intersect, a circular receiving member 30*d* is disposed therewith, having an opening 30*e* formed therein and adapted to movably receive the mounting pins 28 therewith. Thus, the housing H of the catalyst screening unit C of the present invention may in its entirety have a pivotal mount resulting in an adjustable angle of repose with respect to the horizontal merely by appropriately positioning the housing H with the pins 28. Suitable locking means (not shown) such as a bolt and/or set screws and/or the like may preferably be incorporated with the circular receiving member 30 such that the positioning of the housing H is fixed with respect thereto.

Vibrating means V preferably includes a vibrator 32 mounted with the waste chamber 12 for agitating the housing H having the screen S mounted therewith as will be more fully discussed hereinbelow. The vibrator 32 is preferably one that is commercially available and is air-actuated, having a ball-cylinder arrangement for appropriate oscillation, hence vibration of the housing H. Preferably, a separate air line (not shown) at approximately 100 psi is required for proper operation of the vibrator 32.

The vacuum means M includes a first vacuum means A having vacuum outlets 34 mounted with the inclined sides 12*b*, 12*c* of the waste chamber 12, and extend outwardly therefrom. The use and operation of the vacuum means M will be described more fully hereinbelow.

Figure 2:
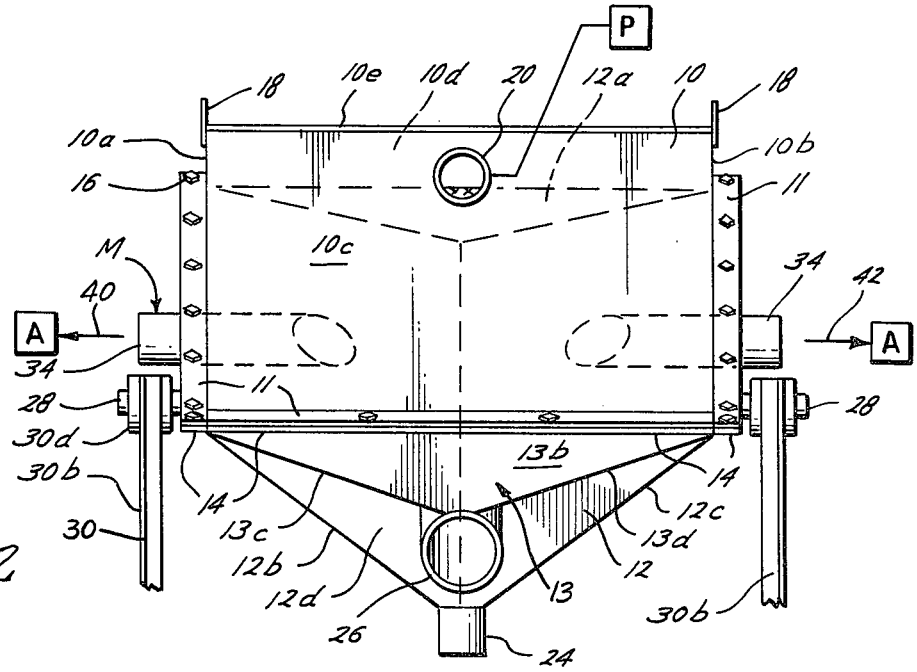
FIG. 2 is a front end view, taken along the lines 2—2 of FIG. 1, of the catalyst screening unit of the present invention.

In the use or operation of the form of the present invention illustrated in FIGS. 1 and 2, the catalyst screening unit C of the present invention is adapted to be used for cleaning broken catalyst, fines, and dust from incoming feed catalyst to isolate and clean the whole catalyst to be used within a catalytic reactor.

The incoming feed catalyst is injected into the housing H under a positive pressure. For example, the inlet pressure through a 4 inch inlet 20 is approximately 1½ pounds per square inch gauge pressure and has an approximate 1,000 cubic feet per minute volumetric displacement of air. Under these inlet conditions, catalyst having a density of 35 pounds per cubic feet may be adequately injected into the housing H.

The incoming feed catalyst flowing in the direction of arrow 36 is blown into the catalyst receiving chamber 10 by a positive pressure means P. The air pressure in conjunction with the vibrating means V and the inclination of the screen S promotes movement of the catalyst across the screen S. As the incoming feed catalyst moves across the screen S, the openings (not numbered) formed in the wire grid 22 allow broken catalyst and fines to fall therethrough into the waste chamber 12. The vibrating means V and the angle of repose of the housing H both promote flow of the separated broken catalyst and fines through the trough-like waste chamber 12 into the vacuum outlet 24.

The broken catalyst-fines vacuum outlet 24 is attached to second vacuum means B for withdrawing the collected broken catalyst and fines outwardly therefrom the waste chamber 12 in the direction of arrow 38. For example, a vacuum of preferably and approximately two inches of mercury at the outlet 28 is suitable for accomplishing this result.

The vacuum means M having vacuum outlets 34 mounted with the waste chamber 12 is attached to first vacuum means A for withdrawing catalytic dust in the incoming feed catalyst. For example, with a vacuum at the vacuum outlets 34 of substantially two inches of mercury, the vacuum withdraws dust in the direction of arrows 40, 42 in similar fashion to that of the vacuum at outlet 24. Thus, the vacuum at vacuum outlets 34, is sufficient to withdraw the dust particles circulating within the housing H including those particles within the catalyst receiving chamber 10 as well as those within the waste chamber 12 without withdrawing broken catalyst and fines which are removed at outlet 24.

The whole catalyst remaining, which is that portion of the incoming feed catalyst that has not fallen through the wire grid 22 and not withdrawn out from outlet 24 or the dust withdrawn from vacuum outlets 34, is vibrated across the screen S into the outlet chamber 13 with the inclined sides 13*c*, 13*d* promoting funnelling-action of the whole catalyst into the outlet 26 and outwardly therefrom in the direction of arrow 44 at slightly-above atmospheric pressure. The exiting whole catalyst, as per the above example, leaves the outlet 44 at a rate of substantially 9,000 pounds of catalyst per hour.

Thus, incoming feed catalyst entering in the direction of arrow 36 through inlet 20 is vibrated, and sized by wire grid 22, separating the broken catalyst, fines, and dust therefrom, the same being withdrawn from the waste receiving chamber 12 with the remaining whole catalyst moving outwardly from the housing H through the outlet chamber 13.

With the pivotal-type mounting of the housing H by the mounting pins 28, the angle of repose of the housing H is suitably made adjustable for appropriate angular displacement of the screen S with respect to the horizontal.

It will be appreciated that air flow is critical to the proper operation of the catalyst screening unit C of the present invention. For example, if the vacuum means M at the vacuum outlets 34, and/or vacuum outlet 24 by first vacuum means A and/or second vacuum means B is greater than required, air could potentially be sucked in through outlet 26 and/or whole catalyst could be held to the screen S due to the negative pressure imposed thereon the whole catalyst while residing on the wire grid 22. Alternatively, if the vacuum means M is not of a proper amount, dust will not be removed from the incoming feed catalyst, hence resulting in an ineffective cleaning operation of the catalyst screening unit C. Therefore, it is manifest that a balance of flow rates be established such that a proper vacuum exists to withdraw not only the dust from within the housing H but also withdraw the broken catalyst and fines therefrom the waste chamber 12 without interfering with the whole catalyst exiting from the outlet 26.

Thus, it is desirable that a maximum amount of catalyst be cleaned of dust, fines, and broken catalyst such that whole catalyst may be loaded within the catalytic reactor. Furthermore, minimum attrition of the catalyst is accomplished with the catalyst screening unit C of the present invention. Inasmuch as vibration alone is too harsh to accomplish the desired results, the combination of vacuum removal of unwanted dust separate from the removal of fines and broken catalyst in conjunction with the pressurized incoming feed catalyst results in a catalyst screening unit C capable of handling large quanities of catalyst with a minimum attrition and destruction of costly catalytic pellets. Furthermore, the outlet 26 is adapted to be affixed to the tubes (not shown) of a catalytic reactor such that the cleaned, whole catalyst may be directly loaded into the tubes for use of the cleaned catalyst therein.

The foregoing disclosure and description of the invention are illustrative and explanatory thereof, and various changes in the size, shape, and materials as well as in the details of the illustrated construction may be made without departing from the spirit of the invention.

I claim:

1. A catalyst screening unit for separating incoming feed catalyst into whole catalyst, broken catalyst, fines, and dust therein for use with a catalytic reactor, comprising:

a housing including a catalyst receiving chamber separated from a lower, waste chamber by an inclined screen, said housing including a positive pressure means mounted with an inlet for delivering incoming feed catalyst into said catalyst receiving chamber under positive pressure and an outlet chamber for discharging whole catalyst therefrom;

a vibrating means mounted with said housing for vibrating said housing and said screen, said inclined screen having properly sized openings therein to allow broken catalyst, fines and dust to pass through said screen with vibration thereof;

said lower, waste chamber including a first vacuum means for substantially removing the dust from said catalyst receiving chamber, from said waste chamber and from the broken catalyst and the fines within said waste chamber;

a second vacuum means for vacuuming the fines from said lower, waste chamber, said second vacuum means mounted with said lower, waste chamber;

said lower, waste chamber further including trough means formed therewith for promoting effective collection of broken catalyst and fines within said lower, waste chamber;

said lower, waste chamber further including a broken catalyst-fines outlet mounted with said lower, waste chamber adjacent said trough means at substantially the lowermost portion of said waste chamber;

said inlet mounted with said catalyst receiving chamber; and, said outlet chamber mounted with said lower, waste chamber.

2. The catalyst screening unit of claim 1, wherein:

said broken catalyst-fines outlet is mounted below said first vacuum means.

* * * * *